US005810244A

United States Patent [19]

Ngai

[11] Patent Number: 5,810,244

[45] Date of Patent: Sep. 22, 1998

[54] VENTILATION SYSTEMS

[75] Inventor: Kwok Man Ngai, Burgess Hill, England

[73] Assignee: Smiths Industries PLC, London, England

[21] Appl. No.: 579,268

[22] Filed: Dec. 27, 1995

[30] Foreign Application Priority Data

Feb. 16, 1995 [GB] United Kingdom ..... 9503016

[51] Int. Cl.[6] ..... G05D 27/02

[52] U.S. Cl. ..... 236/44 C; 165/251; 236/49.3

[58] Field of Search ..... 236/44 C, 49.3; 454/258; 165/251; 62/176.6

[56] References Cited

U.S. PATENT DOCUMENTS

| | | | |
|---|---|---|---|
| 3,979,922 | 9/1976 | Shvait | 165/251 |
| 4,379,484 | 4/1983 | Lom et al. | 165/251 |
| 4,448,597 | 5/1984 | Kuwabara et al. | 62/176.6 |
| 4,570,448 | 2/1986 | Smith | 165/251 |
| 4,889,280 | 12/1989 | Grald et al. | 236/44 C |
| 4,974,665 | 12/1990 | Zillner, Jr. | 165/21 |
| 5,253,804 | 10/1993 | Sarazen, Jr. et al. | 236/44 C |
| 5,303,561 | 4/1994 | Bahel et al. | 62/186 |
| 5,482,210 | 1/1996 | Carey et al. | 236/44 C |

FOREIGN PATENT DOCUMENTS

WO 94/27203 11/1994 WIPO .

*Primary Examiner*—William E. Tapolcai
*Attorney, Agent, or Firm*—Pollock, Vande Sande & Priddy

[57] ABSTRACT

A control for a fan has a temperature sensor and a humidity sensor the outputs of which are supplied to a processor. The processor switches on the fan when certain temperature and humidity conditions are met. The processor turns on the fan in response to an increase in temperature and humidity, a larger increase in humidity being required for a smaller increase in temperature. The fan is also turned on when humidity rises above a certain threshold value, which is lower for higher temperatures.

5 Claims, 1 Drawing Sheet

VENTILATION SYSTEMS

BACKGROUND OF THE INVENTION

This invention relates to ventilation systems.

The invention is more particularly concerned with ventilation systems including a fan or the like that is controlled in accordance with changes in environmental factors.

Fan controllers that respond to a rise in humidity in a room, are known, such as, for example, from GB2133588. One problem with such controllers is that they may cause nuisance switching of the fan, or they may switch the fan on later than is desirable. Nuisance switching can be caused when the room temperature drops, such as at night, since this will lead to a rise in humidity that can be sufficient to trip the fan on. Furthermore, the fan may not be switched on quickly enough when the room temperature rises, such as during cooking or bathing.

BRIEF SUMMARY OF THE INVENTION

It is an object of the present invention to provide improved ventilation systems.

According to one aspect of the present invention there is provided a ventilation system including ventilation means, humidity sensing means, temperature sensing means and processor means arranged to receive outputs from said humidity and temperature sensing means and to provide a ventilation output control signal to activate said ventilation means, said processor means being arranged to provide said ventilation output control signal to said ventilation means in response to a first humidity condition accompanied by a first temperature condition and in response to a second humidity condition different from said first humidity condition accompanied by a second temperature condition different from said first temperature condition.

The first humidity condition may be a first predetermined change in sensed humidity and the first temperature condition a first predetermined change in sensed temperature, the second humidity condition being a second predetermined change in sensed humidity different from said first change, and the second temperature condition being a second predetermined change in temperature different from the first change.

According to another aspect of the present invention there is provided a ventilation system including ventilation means, humidity sensing means, temperature sensing means and processor means arranged to receive outputs from said humidity and temperature sensing means and to provide a ventilation output control signal to activate said ventilation means, the processor means being arranged to provide the ventilation output control to the ventilation means in response to a first predetermined change in sensed humidity accompanied by a first predetermined change in temperature, and in response to a second predetermined change in sensed humidity different from the first change accompanied by a second predetermined change in temperature different from the first change.

The processor means is preferably arranged to produce the output control signals when the first and second changes in temperature are increases in temperature, the first increase being greater than the second, and when the first change in sensed humidity is less than the second. The processor means is preferably arranged to produce the output control signals when the first and second changes in temperature are falls in temperature, the first fall being greater than the second and when the first change in sensed humidity is greater than the second. The processor means may also be arranged to provide a ventilation output control signal when humidity rises above a certain threshold value, which may be different at different temperatures, preferably the humidity threshold being lower at higher temperatures than at lower temperatures.

Alternatively, the first and second humidity conditions may be first and second predetermined values of humidity, said first and second temperature conditions being first and second predetermined values of temperature.

According to a further aspect of the present invention there is provided a ventilation system including ventilation means, humidity sensing means, temperature sensing means and processor means arranged to receive outputs from said humidity and temperature sensing means and to provide ventilation output control signals to activate the ventilation means, the processor means being arranged to provide the ventilation output control to the ventilation means in response to a first predetermined threshold value of humidity being reached at one temperature and in response to a different predetermined value of humidity being reached at a different temperature.

The predetermined values of humidity are preferably lower at higher temperatures than at lower temperatures. The ventilation means may include a fan.

A fan ventilation system including a ventilation fan and a control unit in accordance with the present invention, will now be described, by way of example, with reference to the accompanying drawings.

DETAILED DESCRIPTION OF THE PREFERRED EMBODIMENTS

Figure 1:
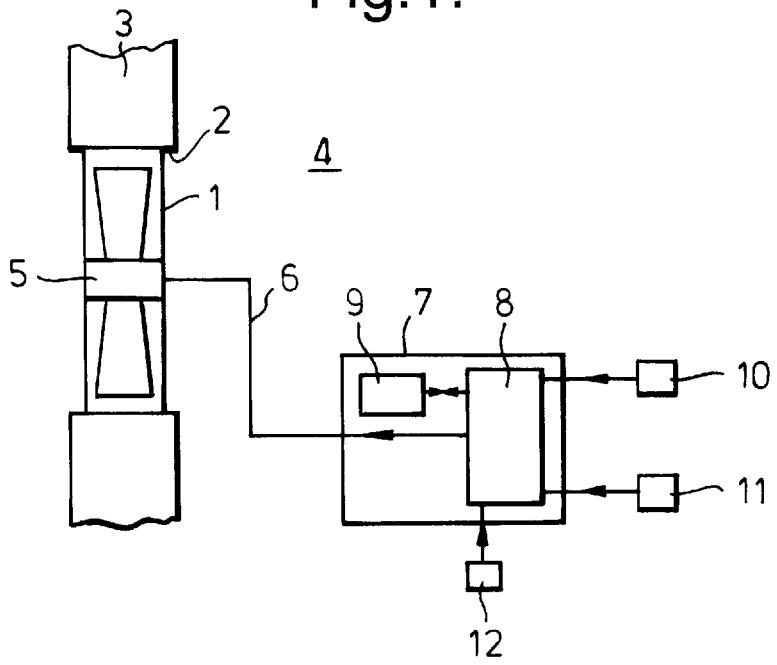
FIG. 1 shows the system schematically.

The fan ventilation system comprises a conventional electric fan 1 mounted in an opening 2 in a wall 3 so as to ventilate a room 4. The fan has an electric motor 5 connected by a wire 6 to a control unit 7, which may be a separate unit or be incorporated into the fan unit. The control unit 7 includes a microprocessor 8 and a memory 9, and is connected to receive inputs from a temperature sensor 10 and a humidity sensor 11 of conventional kind. The control unit 7 also has a manual control 12.

The control unit 7 monitors the temperature and humidity from the sensors 10 and 11 to establish a normal reference level, which is updated at intervals and stored in the memory 9. The microprocessor 8 then compares real time values of temperature and humidity with this reference level to determine whether or not an output signal should be supplied to the fan motor 5 to turn on the fan 1. More particularly, the control unit 7 is arranged to turn the fan 1 on after a predetermined rise in humidity from the reference level. The control unit 7 trips on the fan 1 after a low rise in humidity, if this is accompanied by a large rise in temperature, or after a higher rise in humidity, if this is only accompanied by a relatively small increase in temperature. Also, if there were a fall in temperature from ambient, the control unit 7 would only turn on the fan 1 after a greater increase in humidity than would be necessary to trip at the ambient temperature. The table below is an example of humidity changes necessary to cause the fan 1 to be tripped on for different changes in temperature. The table could be stored as a look-up table in the memory 9 or it could be implemented as an algorithm.

| Temperature Rise °C. | Humidity % change for trip |
|---|---|
| 10 | 20 |
| 8 | 22 |
| 6 | 24 |
| 4 | 26 |
| 2 | 28 |
| 0 | 30 |
| −2 | 32 |
| −4 | 34 |
| −6 | 36 |
| −8 | 38 |

Figure 2:
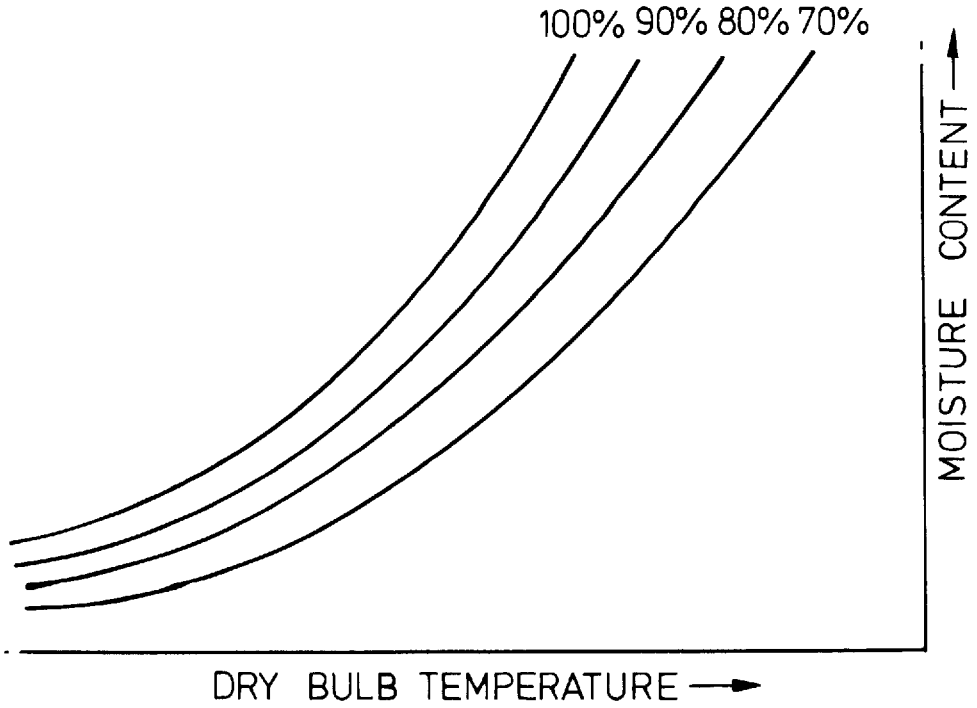
FIG. 2 illustrates variations in humidity with temperature.

FIG. 2 shows the variation in moisture content with temperature at four different saturations: 70%, 80%, 90% and 100%.

Thus, if there were a high level of moisture-causing activity in the room 4, such as cooking, the temperature would rise fairly rapidly, so the fan 1 would be turned on relatively quickly. A low level of activity, however, such as respiration, would only cause a slower temperature rise so it would take longer before the trip value of temperature and humidity was reached. A fall in room temperature, such as at night, would usually lead to a rise in sensed humidity levels but, because this is accompanied by a drop in ambient temperature, this rise in humidity would have to be high before the fan was turned on.

In addition to, or instead of, responding to the above changes in humidity, the system responds when humidity rises above certain threshold values, even if the difference between ambient humidity and these threshold values is less than the values above. This ensures that the fan is operational in situations where there are prolonged high levels of ambient humidity and also improves the response of the controller at night. Different threshold values are set for different temperatures, as illustrated below. This table could be stored as a look-up table or it could be implemented as an algorithm.

| Temperature °C. | Threshold Humidity % |
|---|---|
| 20 | 70 |
| 18 | 75 |
| 16 | 80 |
| 14 | 85 |
| 12 | 90 |
| 10 | 95 |

Once tripped on, the controller checks whether the humidity and temperature have fallen below the trip level. When these values fall below the trip-off level, the controller turns the fan off. The trip-off value could be equal to the trip-on value but would normally be some predetermined value below the trip-on value, or below the ambient value. Alternatively, the fan could simply remain on for a predetermined time and then be turned off.

By contrast, in a conventional, humidity-controlled fan system, the fan would be turned on at the same humidity level, whatever the temperature. Thus, it would either be turned on later than is desirable, when there is a high level of activity, or be turned on too soon, when there is a low level of activity. Also, the increase in humidity caused by a drop in room temperature can be sufficient to trigger a conventional fan to come on, even though there is no need for ventilation. The present invention avoids these disadvantages.

It will be appreciated that the present invention is not restricted to use with fans but could be used with other ventilation devices such as automatic vents. Also, the invention is not confined to ventilation of rooms but could be used in other applications where it is necessary to ventilate a space subject to humidity and temperature changes. The system could be arranged to drive the fan continuously at a low level and then at a higher level when the humidity/temperature rises above the trip level. The control unit need not have a microprocessor but could have a dedicated electrical circuit that performs the necessary monitoring.

What I claim is:

1. A fan system comprising: an electric fan; humidity sensing means; temperature sensing means; processor means; a connection between said humidity sensing means and the processor means; and a connection between said temperature sensing means and the processor means so that the processor means receives outputs from both said humidity sensing means and said temperature sensing means and provides fan output control signals to activate said fan, wherein said processor means is arranged to provide said fan output control signals to said fan both in response to a rise in sensed humidity exceeding a first predetermined rise in humidity accompanied by a rise in sensed temperature exceeding a first predetermined rise in temperature and in response to a second rise in sensed humidity exceeding a second predetermined rise in humidity greater than said first predetermined rise in humidity accompanied by a rise in sensed temperature exceeding a second predetermined rise in temperature lower than said first predetermined rise in temperature.

2. A fan system comprising: an electric fan; humidity sensing means; temperature sensing means; processor means; a connection between said humidity sensing means and the processor means; and a connection between said temperature sensing means and the processor means so that the processor means receives outputs from both said humidity sensing means and said temperature sensing means and provides fan output control signals to activate said fan, wherein said processor means is arranged to provide said fan output control signals to said fan both in response to a fall in sensed humidity exceeding a first predetermined fall in humidity accompanied by a fall in sensed temperature exceeding a first predetermined fall in temperature and in response to a second fall in sensed humidity lower than said first predetermined fall in humidity accompanied by a fall in sensed temperature lower than said first predetermined fall in temperature.

3. A fan system according to claim 1 or 2, wherein said processor means is also arranged to provide a fan output control signal when the sensed humidity rises above a certain humidity threshold value.

4. A fan system according to claim 3, wherein said humidity threshold value is different at different temperatures.

5. A fan system according to claim 4, wherein said humidity threshold value is lower at higher temperatures than at lower temperatures.

* * * * *